US005115726A

United States Patent [19]

Daxer et al.

[11] Patent Number: 5,115,726

[45] Date of Patent: May 26, 1992

[54] TWO-PIECE PISTON ASSEMBLY

[75] Inventors: Georg Daxer, Sao Paulo, Brazil; Joao A. D. T. Cullen, Ann Arbor, Mich.

[73] Assignee: Metal Leve S.A., Sao Paulo, Brazil

[21] Appl. No.: 424,882

[22] Filed: Oct. 20, 1989

[30] Foreign Application Priority Data

Oct. 26, 1988 [BR] Brazil ..... PI 8805717

[51] Int. Cl.[5] ..... F02F 3/00

[52] U.S. Cl. ..... 92/219; 123/193.6; 92/190; 92/238

[58] Field of Search ..... 123/193 P; 92/216, 219, 92/220, 238, 190

[56] References Cited

U.S. PATENT DOCUMENTS 4,013,057 3/1977 Guenther ..... 92/190
4,358,881 11/1982 Mahrus et al. ..... 92/238
4,811,654 3/1989 Rosch ..... 92/216

FOREIGN PATENT DOCUMENTS 0714344 11/1931 France ..... 92/190

*Primary Examiner*—Andrew M. Dolinar
*Assistant Examiner*—M. Macy
*Attorney, Agent, or Firm*—Darby & Darby

[57] ABSTRACT

A two-piece, or articulated, piston assembly for internal combustion engines, comprising a head composed of a top portion and a pair of pin bosses integral with it, a skirt portion, and a wrist pin mounted in the pin boss holes. The pin bosses are secured to a member restraining lateral deformation of the pin bosses. The restraining member may be the wrist pin itself, or defined by a cylindrical hollow pin fastened to the pin boss holes and housing the wrist pin. The thus formed structure prevents deformation of the pin bosses toward the cylinder liner, thereby imparting a higher strength to the piston assembly.

15 Claims, 3 Drawing Sheets

TWO-PIECE PISTON ASSEMBLY

BACKGROUND OF THE INVENTION

The present invention relates to a piston for internal combustion engines, particularly a piston of the two-piece, or articulated, type.

The two-piece pistons represent a major contribution to an improvement in the performance of internal combustion engines. The basic construction of the two-piece piston comprises a top portion, or head, generally of cast iron or steel, from whose lower part and integral with it depend a pair of legs for bearing a wrist pin which connects the head portion to another member, the skirt, generally of aluminum or an aluminum alloy, designed to guide the piston in the cylinder liner.

The two-piece piston offers several advantages. One important advantage is a lower top land height, thus decreasing the crevice volume, i.e., the volume within the room defined by the top land and the cylinder liner, hereby reducing engine emissions. The piston head is made of materials having a low coefficient of thermal conductivity, generally iron or steel, which helps to maintain ideal temperatures for a complete combustion of the fuel-air mixture and, accordingly, a reduction of engine emissions. Also, the use of iron or steel for the piston top makes this component compatible with other engine components such as the cylinder liner and the cylinder head, also of iron or steel, regarding coefficients of thermal expansion.

There are also many other advantages provided by this type of piston, such as, for instance, the high strength of the head even at high temperatures, as a result of the material of which the head is usually made. The lower portion, or skirt, generally of aluminum or an aluminum alloy, is extremely light, thus contributing to reduce the total weight of the assembly.

Another advantage of the two-piece, or articulated, pistons is that their components are independent and do not make contact with each other with the piston in operation in the engine.

Thus, the heat generated in the combustion region is not transmitted from the head to the skirt, whereby it is possible to mount the piston in the cylinder liner with extremely small clearances thereby attaining a remarkable reduction in engine noise levels even at cold starts.

In conclusion, it is a common understanding that two-piece, or articulated, pistons are quite appropriate for internal combustion engines, particularly diesel engines having a high specific output and a low level of emissions and noise. Therefore, the articulated pistons meet the most advanced operating demands, including strict legal requirements concerning emissions and engine noise. While exhibiting an advanced concept, the two-piece pistons may be i proved in order to overcome certain operating shortcomings. One problem attending all two-piece pistons results from the thermomechanical load to which the pin bosses are subjected. When the piston is on its top dead center or close to it, the fuel-air mixture is burned and generates a heavy thermomechanical load which is transmitted to the pin bosses depending from the piston head and whose function is to accommodate the piston pin.

Owing to the load transmitted by the head to the pin bosses, the later tend to deform outwardly in the direction of the skirt innerwall, urging the skirt against the cylinder liner. These deformations subject the pin bosses to a structural fatigue, thus reducing their service life. In addition, these deformations impose a need for a substantially reinforced piston pin capable of withstanding the bending caused by the compressive forces arising out of such deformation. This known solution is not recommended as it contribute to an increase of the total weight of the assembly. There have been few alternatives for improving the strength of the piston assembly, and most of these alternatives cause a weight increase.

OBJECTS OF THE INVENTION

It is, therefore, one object of the present invention to provide a two-piece piston having an increased structural strength.

It is an addition object of the present invention to provide a two-piece piston which is less expensive than the two-piece pistons known heretofore.

It is a further object of the present invention to provide a two-piece piston which affords mounting the piston with smaller skirt-cylinder liner clearance.

BRIEF DESCRIPTION OF INVENTION

The present invention relies on the principle that the deformation of the pin bosses can be controlled by using the pin boss and pin structure itself instead of reinforcing the pin bosses or the wrist pin as is usual in the art.

The object of the present invention affords using a smaller and lighter wrist pin, which contributes to decrease the total weight of the assembly and, accordingly, reduce fuel consumption and engine vibration. There is also the possibility of shortening the wrist pin and reducing the width of the pin bosses due to an increase of their load capacity, which eliminates certain restrictions to the formation of a hydrodynamic oil film between the piston and the cylinder wall. It is well known by those skilled in the art that during the critical deformations of the pin bosses same tend to deform outwardly in the direction of the cylinder wall, which causes the wrist pin to bend. It is also known that before reaching the maximum deformation the pin bosses travel over the outside diameter of the wrist pin owing to the mounting clearance between the wrist pin and the pin bosses. This allows the wrist pin to slide over and rotate in the pin bosses, which ultimately creates the sliding conditions for the undesirable lateral deformation of the pin bosses resulting from the compression loads generated by the combustion process on the piston top. The lack of any structural reinforcement in the direction of deformation of the pin bosses is also accountable for such deformation on two-piece pistons.

Therefore, it is the main object of the present invention to control and restrain the deformation of the pin bosses, the wrist pin and the skirt of two-piece, or articulated, pistons by means of the suppression of the clearance between the pin bosses and the wrist pin, and by providing the assembly with structural reinforcing means in the main direction of lateral deformation of the pin bosses, wrist pin and piston skirt. These combined solutions are carried out by the axial and rotary fastening of a member for limiting the lateral deformation of the pin bosses. Said limiting member may be the wrist pin itself. The fastening, which can be performed by physical or chemical means, provides the suppression of the clearance between the pin bosses and the wrist pin when the wrist pin itself is the limiting member. In addition, this constructive approach imparts structural reinforcing functions to the wrist pin, acting exactly in the main direction of said lateral deformation of the pin bosses. The fastening of the wrist pin to the pin bosses on two-piece pistons according to the present invention can be performed in different manners, each one designed for specific uses. For instance, the fastening can be of the type that affords the removal of the two-piece piston for service or replacement of parts.

Alternatively, the fastening can be made in a permanent fashion, without allowing the removal or disassembly of the piston as, for instance, for the so-called one-way, or disposable, engines. Another advantage of this type of two-piece piston is the possibility of designing and using shorter and lighter piston pins. It also allows to dispense with the machining of the pin boss holes, close mounting tolerances, a fine surface finish, and pin locking ring grooves.

BRIEF DESCRIPTION OF THE DRAWINGS

Some embodiments of the present invention are hereinafter described with reference to the accompanying drawings, the description and the drawings being intended as merely exemplary and in no way restrictive. In the drawings.

DETAILED DESCRIPTION OF THE INVENTION

Figure 1:
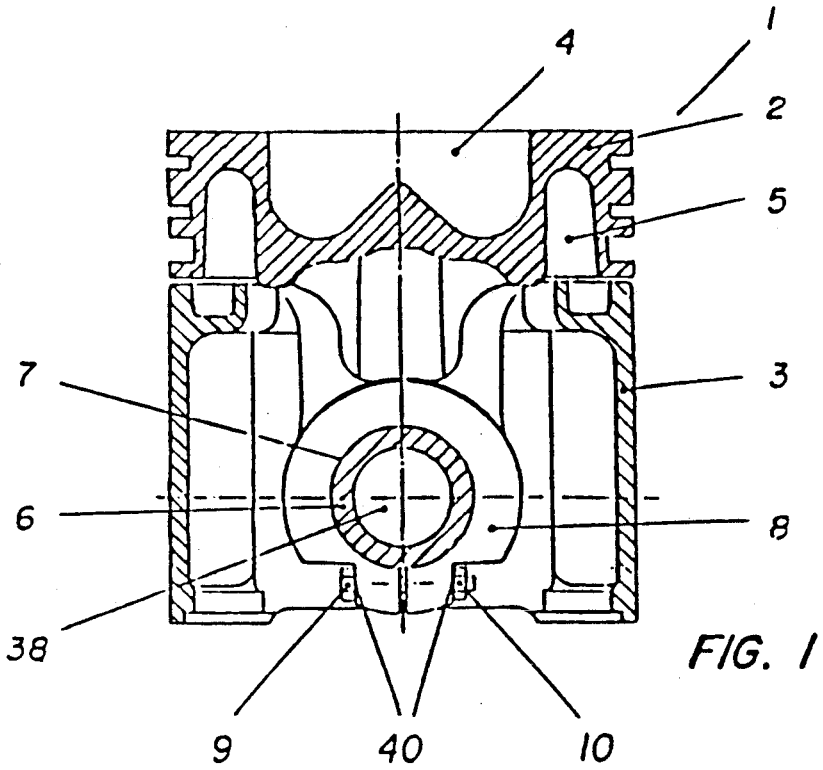
FIG. 1 is a longitudinal section view of a two-piece piston taken along a line perpendicular to the pin axis, according to a preferred embodiment of the invention.

According to a preferred embodiment of the present invention, the two-piece piston 1, composed of a head 2 and a skirt 3, provided in this embodiment with a combustion bowl 4 and a cooling chamber 5, is also provided with a pin 6 fastened to the holes 7 of the pin bosses 8 by the pressure applied by the tightening o the bolts 9 and nuts 10 which bear against the recesses 40 on the annular and split lower end portion of the pin bosses 8.

Figure 2:
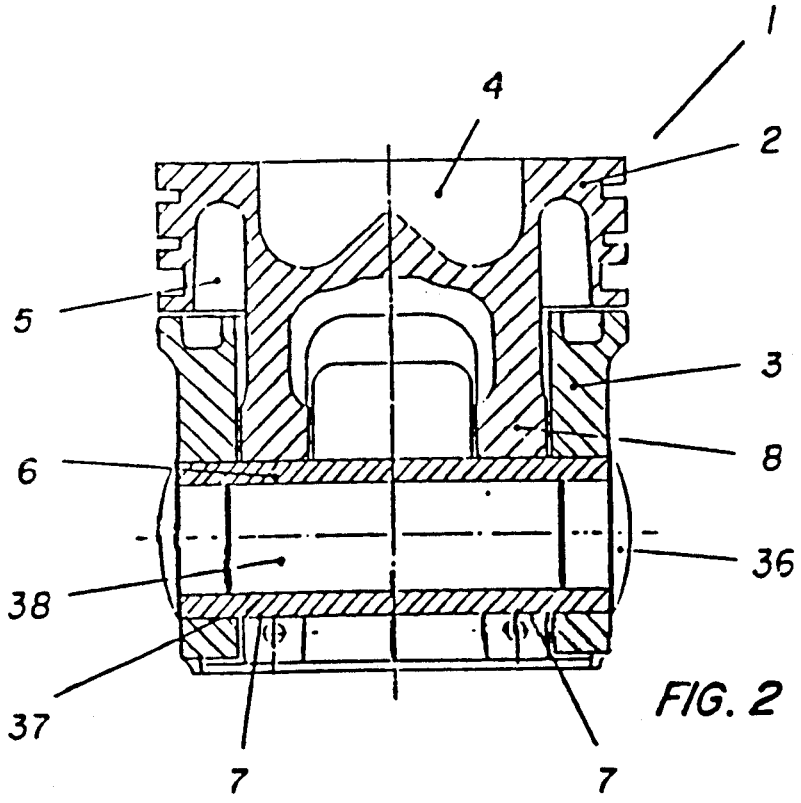
FIG. 2 depicts the piston of FIG. 1, in a longitudinal section view taken along the pin axis.

When the piston 1 is on its top dead center (not shown) or close to it, the fuel-air mixture in the combustion bowl 4 burns and generates a thermomechanical force that urges the piston 1 downwards toward the lower dead center (not shown). In conventional two-piece pistons, this thermomechanical load causes the pin bosses to deform outwardly in the direction of the cylinder wall (not shown). However, in the piston of the present invention the thermomechanical load is withstood by the improved structure provided by the fastening of the wrist pin 6 to the pin bosses 8 by means of the bolt 9 and nut 10, as shown in FIG. 1, thereby preventing t he deformation of the pin bosses, wrist pin and piston skirt. As shown in FIG. 2, the ends of pin 6 may be provided with caps 36 fitted in the inside diameter of the pin 6 through the hole 37 of skirt 3.

Figure 3:
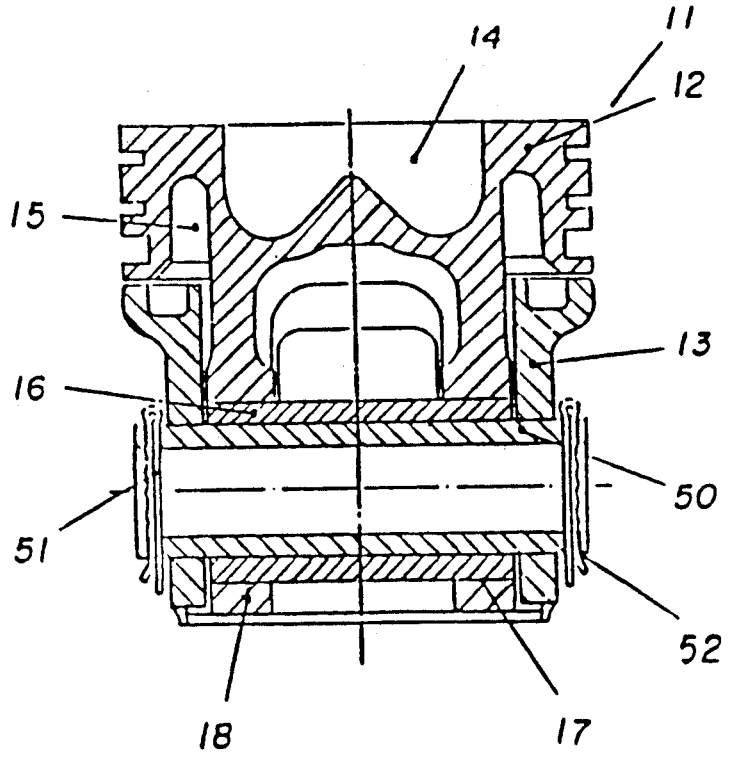
FIG. 3 is a longitudinal section view of a two-piece piston taken along the pin axis, illustrating an alternative embodiment of the invention.
Figure 4:
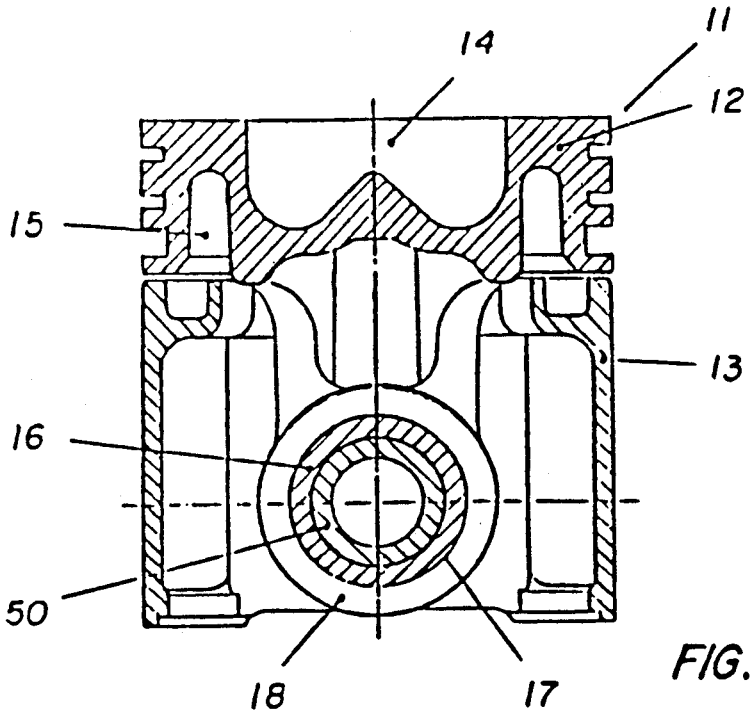
FIG. 4 is a longitudinal section view of the piston in FIG. 3 taken along the cross section of the piston pin.

In the alternative embodiment illustrated in FIG. 3 and 4, the two-piece piston 11, provided with the head 12 and skirt 13, a combustion bowl 14 and a cooling chamber 15, is also provided with a wrist pin 16 fastened to the pin bosses 18 in the portion 17. In this embodiment, the wrist pin 16 is shorter and lighter and the assembly is provided with an auxiliary pin 50 which bears the skirt 13 and is locked to it by means of clips 51, on grooves 52 at its ends.

The fastening of pin 16 on holes 17 is carried out by welding, e.g., electron beam or laser beam welding.

Figure 5:
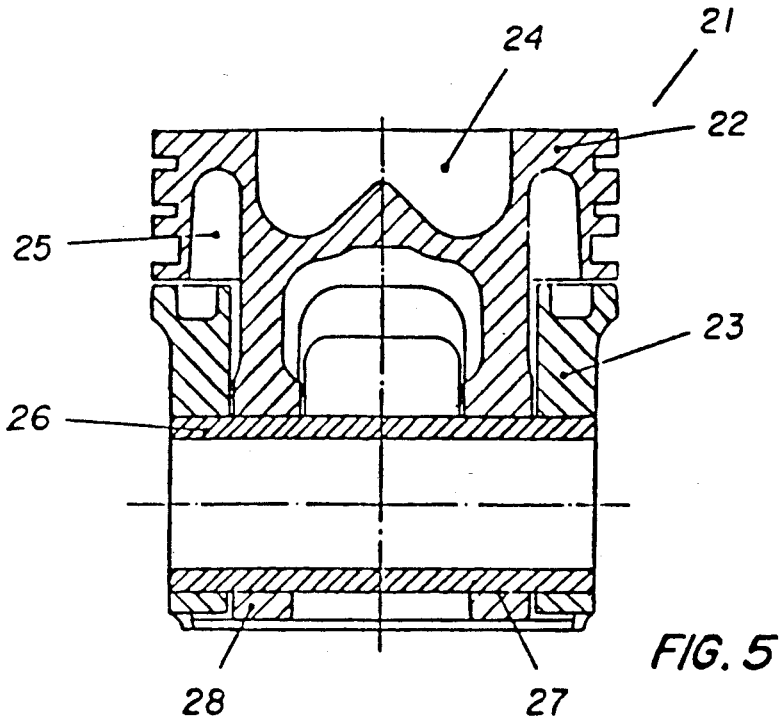
FIG. 5 is a longitudinal section view of the two-piece piston of the invention, taken along the pin axis, representing another alternative embodiment of the invention, designed particularly for application in one-way, or disposable, engines.
Figure 6:
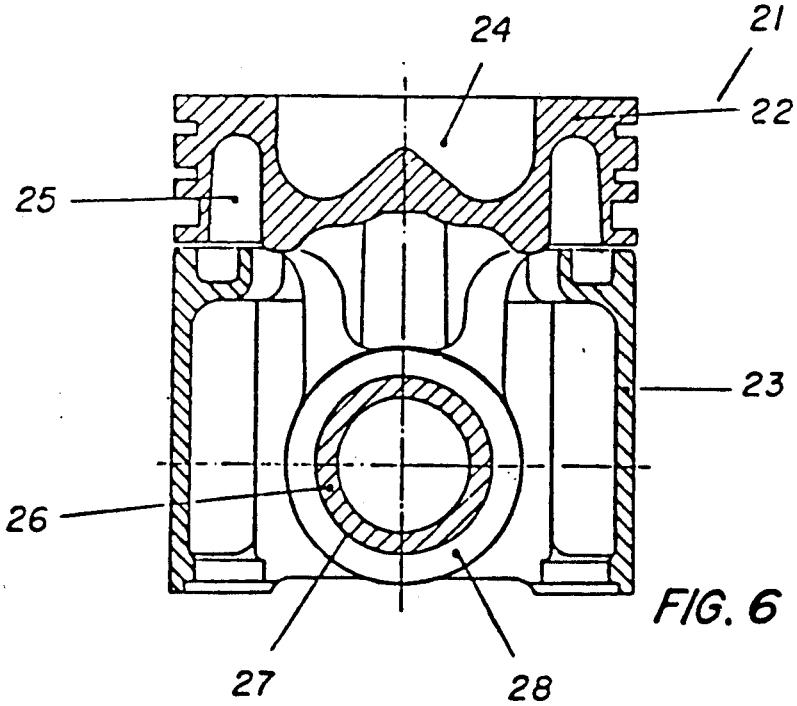
FIG. 6 is a longitudinal section view of the piston in FIG. 5 taken along the cross section of the piston pin.

In another embodiment, illustrated in FIG. 5 and 6, intended for application in the so-called one-way, or disposable, engines, the piston 21, having a head 22 and a skirt 23, a combustion bowl 24 and a cooling chamber 25, is provided with a wrist pin 26 fastened to the pin bosses 28, on the region of holes 27, by a tight fit method by heating up the holes 27 of a temperature of about 60° C. to about 130° C., then inserting the pin 26 and rapidly cooling the assembly, thereby providing a secure fastening of the pin to the boss holes. As in the aforementioned embodiments, this embodiment imparts an improved structural strength to the assembly and restrains deformation of the pin bosses.

We claim:

1. A two-piece piston assembly for internal combustion engines comprising: a head incorporating a pair of pin bosses depending from its lower portion, each provided with a wrist pin hole; an independent skirt; and a wrist pin for mounting the skirt on the pin bosses; and means connecting said wrist pin to said pin bosses for restraining lateral movement of the pin bosses.

2. The two-piece piston defined in claim 1, wherein the pin boss lower ends are split and provided with tightening means which fasten the wrist pin to the pin bosses.

3. The two-piece piston defined in claim 1, wherein the skirt is mounted on the wrist pin ends by means of caps fitted in the wrist pin ends.

4. The two-piece piston defined in claim 1, wherein the skirt is mounted directly on the wrist pin ends.

5. The two-piece piston defines in claim 1, wherein said restraining member also prevents longitudinal and rotary movements of the wrist pin.

6. The two-piece piston defined in claim 2, wherein the skirt is mounted directly on the wrist pin ends.

7. The two-piece piston defined in claim 2, wherein said restraining member comprises a direct connection between the interior of the pin boss holes and the wrist pin.

8. The two-piece piston defined in claim 5, wherein the skirt is mounted directly on the wrist pin ends.

9. The two-piece piston defined in claim 7, wherein the connection of the pin bosses to the wrist pin is made by heating the pin boss surrounding its hole portion, fitting the wrist pin into the pin boss holes and rapidly cooling the assembly.

10. The two-piece piston defined in claim 7, wherein the skirt is mounted directly on the wrist pin ends.

11. A two-piece piston assembly for internal combustion engines comprising: a head incorporating a pair of pin bosses depending from its lower portion, each provided with a wrist pin hole; an independent skirt; and a wrist pin for mounting the skirt on the pin bosses; and a cylindrical hollow shaft having its ends secured to the pin boss holes for restraining lateral movement of the pin bosses, said cylindrical hollow shaft housing said wrist pin.

12. The two-piece piston defined in claim 11, wherein the skirt is mounted directly on the wrist pin ends.

13. The two-piece piston defined in claim 11, wherein the skirt is mounted directly on the wrist pin ends.

14. A two-piece piston assembly for internal combustion engines comprising: a head incorporating a pair of pin bosses depending from its lower portion, each provided with a wrist pin hole; an independent skirt; and a wrist pin passing through the holes of the pin bosses for mounting the skirt on the pin bosses; the skirt being mounted directly on the ends of the wrist pin for restraining lateral movement of the pin bosses.

15. A two-piece piston assembly for internal combustion engines comprising: a h ead incorporating a pair of pin bosses depending from its lower portion each provided with a wrist pin hole; an independent skirt; and a wrist pin passing through the holes of said pin bosses; the skirt being mounted on the wrist pin ends by means of caps fitted on the wrist pin ends for restraining lateral movement of the pin bosses.

* * * * *

UNITED STATES PATENT AND TRADEMARK OFFICE

CERTIFICATE OF CORRECTION

PATENT NO. : 5,115,726

DATED : May 26, 1992

INVENTOR(S) : Georg Daxer; Joao A. D. T. Cullen

It is certified that error appears in the above-identified patent and that said Letters Patent is hereby corrected as shown below:

In the cover page of the patent, Section (73), please delete "Metal Leve S. A." and substitute therefor —Metal Leve S. A. Indústria e Comércio—.

Signed and Sealed this

Thirteenth Day of September, 1994

*Attest:*

*Attesting Officer*

Bruce Lehman

BRUCE LEHMAN

*Commissioner of Patents and Trademarks*